US005906906A

United States Patent [19]

Inoue et al.

[11] Patent Number: 5,906,906

[45] Date of Patent: May 25, 1999

[54] RECYCLE DEVELOPING PROCESS

[75] Inventors: Masahide Inoue; Takeshi Arakawa; Yutaka Aso; Ryo Fujisawa; Mamoru Kato, all of Osaka, Japan

[73] Assignee: Mita Industrial Co., Ltd., Osaka, Japan

[21] Appl. No.: 08/804,571

[22] Filed: Feb. 24, 1997

Related U.S. Application Data

[63] Continuation-in-part of application No. 08/520,090, Aug. 28, 1995, abandoned.

[30] Foreign Application Priority Data

Aug. 29, 1994 [JP] Japan ..... 6-203261

[51] Int. Cl.[6] ..... G03G 13/095

[52] U.S. Cl. ..... 430/125; 430/110; 399/359

[58] Field of Search ..... 430/125, 110; 399/359

[56] References Cited

U.S. PATENT DOCUMENTS

| | | | |
|---|---|---|---|
| 5,200,788 | 4/1993 | Thayer | 355/298 |
| 5,234,786 | 8/1993 | Ueda et al. . | |
| 5,272,040 | 12/1993 | Nakasawa et al. | 430/110 |
| 5,307,128 | 4/1994 | Murasaki et al. . | |
| 5,737,680 | 4/1998 | Takagaki et al. | 399/359 |

FOREIGN PATENT DOCUMENTS

| | | |
|---|---|---|
| 0282223 | 9/1988 | European Pat. Off. . |
| 0431930 | 6/1991 | European Pat. Off. . |
| 0488789 | 6/1992 | European Pat. Off. . |

OTHER PUBLICATIONS

Diamond, Arthur S. Handbook of Imaging Materials. New York: Marcel–Dekker, Inc. pp. 210–213, 1991.

Borsenberger, Paul M. & David S. Weiss. Organic Photoreceptors for Imaging Systems. New York: Marcel–Dekker, Inc. pp. 6–17, 1993.

*Primary Examiner*—Christopher D. Rodee

*Attorney, Agent, or Firm*—Sherman and Shalloway

[57] ABSTRACT

The present invention relates to a recycle developing process which comprises developing an electrostatic image formed on a photosensitive material with a starting developer filled in a developing vessel, transferring the toner image to a predetermined paper, recovering the toner remaining on the photosensitive material by a cleaning means, and repeating the developing procedure while replenishing a virgin toner and the toner recovered by the cleaning means into the developing vessel; wherein the virgin toner to be replenished into the developing vessel is that which is fulfilled in a container wherein a rotating roller is provided in an opening portion at a lower portion has a flowability, shown as a fallen amount of the toner at a time of falling via the rotating roller for a certain fixed time, of 50 to 70% based on the toner in the starting developer.

According to this process, an abrupt decrease in the properties of the developer due to the mixing of the recovered toner can be relaxed. As a result, a stable image free from fogging or toner scattering can be formed by the recycle developing process.

1 Claim, 3 Drawing Sheets

RECYCLE DEVELOPING PROCESS

This application is a continuation-in-part of application Ser. No. 08/520,090, filed Aug. 28, 1995 abandoned.

BACKGROUND OF THE INVENTION

1. Field of the Invention

This invention relates to a recycle developing process used in an electrophotographic apparatus such as a copying machine or a printer.

2. Description of the Prior Art

Generally, image formation in electrophotography is carried out by charging (main charging) the surface of a photosensitive material, imagewise exposing the charged material to form an electrostatic image on the surface of the photosensitive material, developing the image with a developer filled in a developing vessel to form a visualized toner image, transferring the toner image to a predetermined paper, and removing the toner remaining on the photosensitive material after the transferring by using a device such as a cleaning blade to complete one cycle of image forming step.

A typical developer is, for example, a two-component magnetic developer composed of an electroscopic toner made of a colored resin composition and a magnetic carrier. The developer is delivered to a developing zone in the form of a magnetic brush by means of a developer conveying sleeve provided in a developing vessel, sliding the magnetic brush with the electrostatic image on the photosensitive material, and adhering the toner to the electrostatic image to thereby perform development.

Recently, many recycle developing processes in which a toner removed and recovered by cleaning is again recirculated into a developing vessel and again used for development with an object of reutilizing toners have been proposed, and have been applied to actual electrophotographic apparatuses. This recycle developing process is applied to inexpensive low-speed machines using organic photosensitive materials (OPC) in general.

In this recycle developing process, when a toner in the starting developer filled in the developing vessel is consumed and reaches a concentration of a predetermined level or below, a virgin toner is replenished from a feeding hopper, and a toner recovered by cleaning is also replenished.

However, in the above-mentioned recycle developing method, there is a problem in that the properties of a recovered toner to be used again after recovering by cleaning are different from the properties of a toner contained in the starting developer or those of a virgin toner supplied to a developing vessel.

For example, the surface of the toner is surface-treated with a treating agent such as silica or alumina so that its properties such as flowability may be held stably. However, the toner which is supplied for development is adhered to the surface of the photosensitive material and thereafter is recovered by cleaning, the surface treating agent is removed or embedded in the toner particles due to an external force of cleaning or to a force exerted after recovering in the step of conveying into the developing vessel. Thus, the toner has an extremely decreased flowability. Accordingly, as the recovered toner is replenished into the developing vessel, the flowability of the developer decreases. Especially when some degree of development is conducted, the toner in the developer contained in the developing vessel all becomes a recovered toner, and the properties of the toner become very much different from the initial developing agent, and it becomes difficult to perform development stably.

In the developing vessel, a toner concentration sensor is provided so that the toner concentration (T/D) of a developer composed of a toner and a carrier may be controlled within a predetermined range. Controlling of this toner concentration is carried out by utilizing the variation of the toner concentration in the developer corresponding to the permeability of the developer. The permeability of the developer is detected by the toner concentration sensor and the toner is replenished into the developing vessel according to the output value of the sensor.

Changes in the properties of the developer by the replenishing of the recovered toner adversely affect the controlling of the toner concentration. For example, curve A in FIG. 3 shows the relation between the output (corresponding to the permeability of the developer) of the concentration sensor in the starting developer and the toner concentration (T/D). According to this curve, if the threshold value of ON-OFF of toner replenishing is set at a sensor output value 3V, the toner is replenished to the developing vessel when the toner concentration becomes 3.5% or below. However, when the recovered toner is replenished into the developing vessel, the properties vary and the relation between the output of the concentration sensor and the toner concentration changes to, for example, curve B. Therefore, by the above-mentioned setting of the threshold value, it will become difficult to maintain the toner concentration at a predetermined level.

SUMMARY OF THE INVENTION

It is an object of this invention to provide a developing process capable of forming a stable image by suppressing a decrease in the properties of a developer by mixing a recovered toner in a recycle developing process in which the toner recovered by cleaning is recirculated into a developing vessel.

It is another object of this invention to provide a developing process capable of holding a toner concentration stably even when the recovered toner is supplied into the developing process in the above-mentioned recycle developing process.

According to this invention, there is provided a recycle developing process which comprises developing an electrostatic image formed on a photosensitive material with a starting developer composed of an electroscopic toner and a magnetic carrier filled in a developing vessel to form a toner image, transferring the toner image to a predetermined paper, recovering the toner remaining on the photosensitive material by a cleaning means, and repeatedly performing development while replenishing a virgin toner and the toner recovered by the cleaning means into the developing vessel; wherein the virgin toner to replenished into the developing vessel has a flowability of 50 to 70% based on that of the toner in the starting developer, the flowability being shown as a toner falling amount that is measured by filling the toner in the container in which a rotating roller is provided in an opening portion at a lower portion and falling the toner via the rotating roller for a certain fixed time.

In the above-mentioned developing process, it is preferred to detect the toner concentration of the developer in the developing vessel and replenishing the virgin toner into the developing vessel based on the detected value. Especially, it is desirable to vary the detected value of the sensor, which becomes the threshold value of ON-OFF control of the supply of the virgin toner, depending upon the action time of an image forming cycle.

DETAILED DESCRIPTION OF THE INVENTION

The present invention is directed to a recycle developing process which comprises: developing an electrostatic image formed on a photosensitive material with a starting developer composed of an electroscopic toner and a magnetic carrier filled in a developing vessel to form a toner image, said starting developer having a predetermined concentration of toner therein; transferring the toner image to a predetermined paper; recovering the toner remaining on a photosensitive material by a cleaning means; and repeatedly performing development while maintaining said predetermined concentration of toner in the developer by replenishing a virgin toner and the toner recovered by the cleaning means into the developing vessel; wherein the virgin toner to be replenished into the developing vessel has a flowability of 50 to 70% based on that of the toner in the starting developer, the flowability being shown as a toner falling amount that is measured by filling the toner in a container in which a rotating roller is provided in an opening portion at a lower portion and falling the toner via the rotating roller for a certain fixed time; wherein the toner in the starting developer is surface-treated with flowability improver particles having a particle diameter of 0.005 to 0.05 $\mu$m and spacer particles having a particle diameter of 0.05 to 1.0 $\mu$m; wherein the amount of spacer particles contained in the replenishing virgin toner is larger than that of the spacer particles in the toner in the starting developer.

In the recycle developing process, development in an early period is carried out by using a starting developer. When a certain amount of the toner is consumed by the repetition of development, a virgin toner is replenished in order to maintain the toner concentration of the developer. When the development is repeated, the toner recovered by cleaning is replenished together with the virgin toner and finally development is carried out with the developer containing only the recovered toner.

In the present invention, the virgin toner to be replenished into the developing vessel, which has a lower flowability than the toner in the starting developer, is used whereby an abrupt decrease in the properties of the developer due to the use of the recovered toner is suppressed, and the development can be carried out stably even if the recovered toner is used. The decrease in the properties of the developer due to the mixing of the recovered toner is relaxed by the replenishing of the virgin toner.

Figure 4:
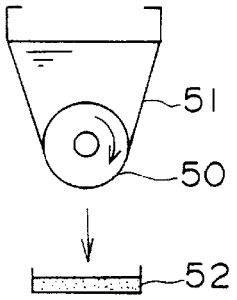
FIG. 4 is a view showing a tester for measuring the falling amount of a toner.

In the present invention, the flowability of the toner is shown as the amount of the toner which falls, when the toner filled in a container in which a rotating roller is provided in an opening portion at a lower portion, via the rotating roller for a certain period of time. As shown in FIG. 4, a fixed amount of the toner is filled in a container 51 (taper angle 60 degrees) in which a rotating roller 50 is provided in an opening portion at a lower portion, and by rotating the rotating roller 50 at a fixed speed, the toner is fallen to a receiver 52 at a lower portion. After the lapse of a fixed period of time, the falling amount of the toner is measured. This falling amount becomes an index showing flowability. Accordingly, as the falling amount is larger, the flowability is higher. When the falling amount of the toner is smaller, the flowability becomes lower. The measurement of the falling amount of the toner is carried out by using a brass rotating roller 50 having a diameter of 20 mm, filling 20 g of the toner in the container 51, prescribing the rotating number of the rotating roller 50 at 3 rpm, and falling the toner over the course of 5 minutes.

In the present invention, the flowability of the virgin toner to be replenished (the above-mentioned falling amount of the toner) is adjusted to 50 to 70%, especially 55 to 65%, of the toner in the starting developer. If the flowability is higher than the above-mentioned range, the supply of the recovered toner markedly lowers the properties of the toner, especially its flowability. Thus, the development cannot be carried out stably, and for example, inconveniences such as toner scattering and fogging occur in the formed image.

The adjustment of the flowability of the toner can be performed by adjusting the amount or particle diameter of the surface treating agent to be outwardly sprinkled on the surface of the toner.

In the recycle developing method of this invention, a decrease in the properties of the developer due to the mixing of the recovered toner is relaxed. Thus, by detecting the toner concentration of the developer in the developing vessel and replenishing the virgin toner into the developing vessel based on the detected value, development may be carried out while holding a fixed toner concentration. Especially by varying the sensor detected value, which becomes the threshold value of ON-OFF control of the supply of the virgin toner, according to the action time of image forming cycle, a fixed toner concentration can always be held.

Since the action time of image forming cycle corresponds to, for example, the action time of a sleeve for conveying the developer provided in the developing vessel, the threshold value may be varied according to the integrated value of the driving time of a driving motor for the sleeve.

(Electrophotographic Apparatus)

Figure 1:
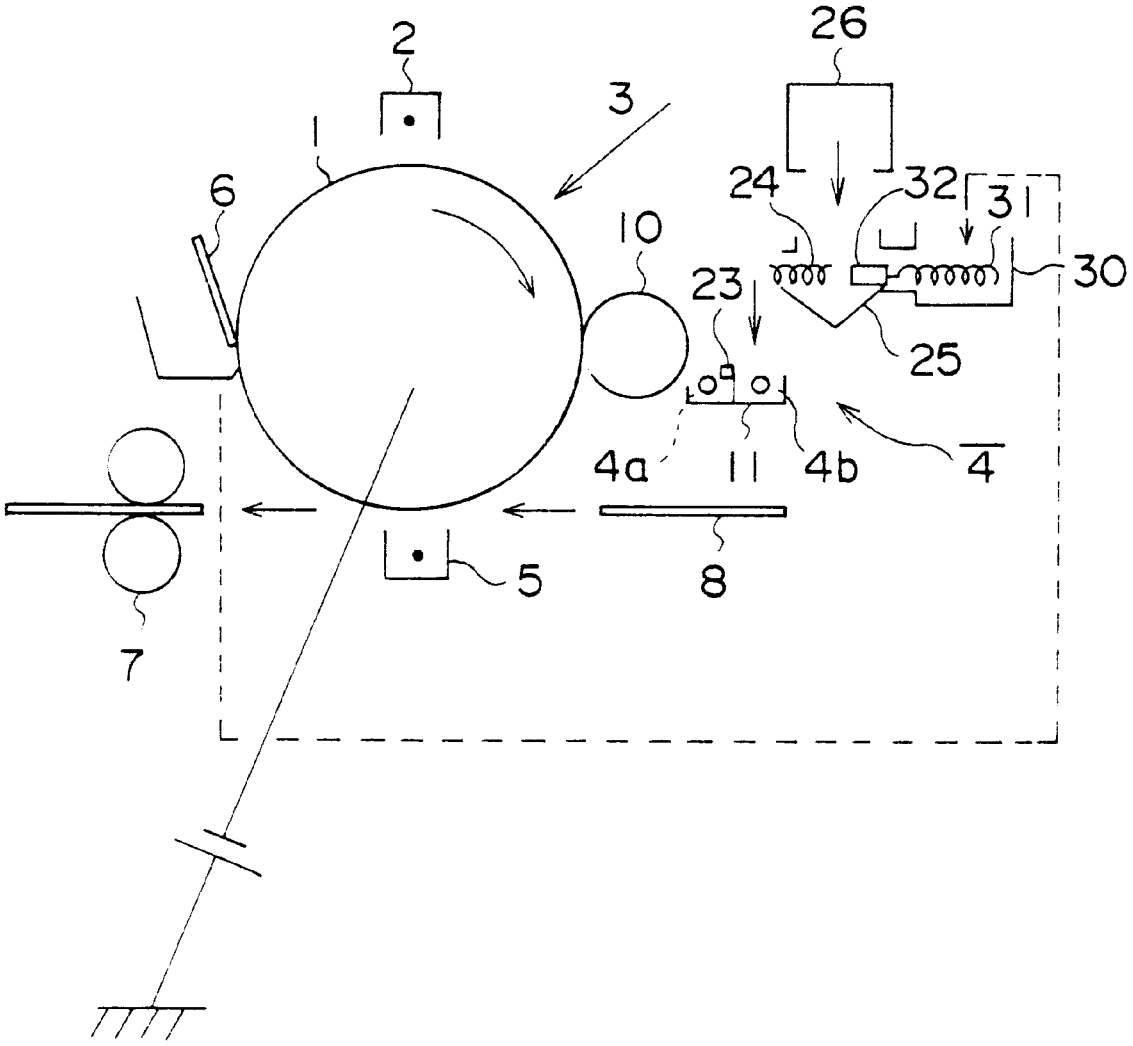
FIG. 1 is a view showing one example of an electrophotographic apparatus for conveniently practicing the recycle developing process of this invention.

With reference to FIG. 1 which briefly shows one example of an electrophotographic apparatus for favorably practicing the recycle developing process of this invention, a main charging device 2, an optical system 3, a developing apparatus 4, a transferring charging device 5 and a cleaning apparatus 6 such as a cleaning blade are sequentially provided around a photosensitive drum 1. Furthermore, a fixing apparatus 7 is provided adjacently to the photosensitive drum 1.

The surface of the photosensitive drum 1 is charged by the main charging apparatus 2, and imagewise exposed by the optical system 3 to form an electrostatic image on the photosensitive drum 1. This electrostatic image is then developed by the developing apparatus 4 to form a visualized toner image, and is transferred to a predetermined paper 8 by the transferring charging device 5. The paper 8 bearing the transferred toner image is introduced into the fixing apparatus 7 and the toner image is fixed with heat, pressure, etc. The toner remaining on the photosensitive drum 1 after transferring is removed from the surface of the photosensitive drum 1 by the cleaning apparatus 6, and recovered. In this way, one step of image forming cycle is completed.

(Developing Apparatus)

The above developing apparatus 4 is provided with a developer conveying sleeve 10 having a magnet inside and a developing vessel 11. A developer is filled inside in the developing vessel 11. This developer is conveyed by the sleeve 10 in the form of a magnetic brush, this magnetic brush is abraded by the surface of the photosensitive drum 1, and a charging toner adheres to the electrostatic image to form a toner image.

Figure 2:
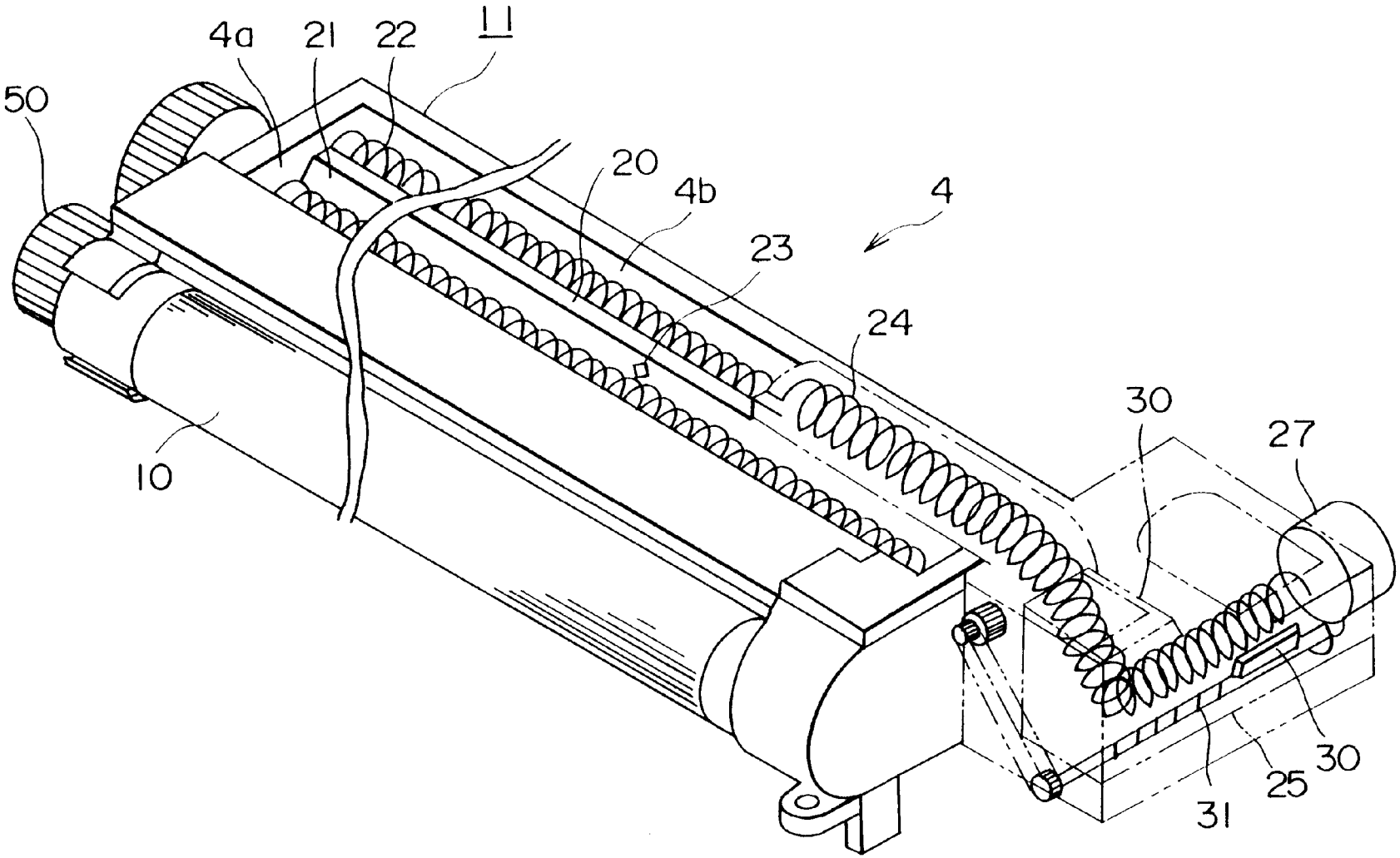
FIG. 2 is a view showing principal parts of a developing apparatus used in FIG. 1.
Figure 3:
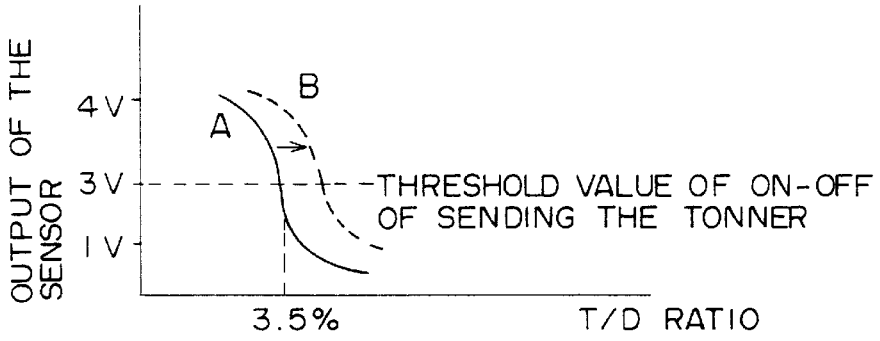
FIG. 3 is a diagram showing the relation between the output of a toner concentration sensor and the toner concentration.

The structure of this developing apparatus 3 is shown in FIG. 2. As can be understood from FIGS. 1 and 2, the developing vessel 11 is partitioned into two chambers 4*a* and 4*b* by a partitioning wall 20, and spirals 21 and 22 are provided in each of the chamber. A toner concentration sensor 23 is provided in the partitioning wall 20. Furthermore, one chamber 4*b* communicates with a toner replenishing hopper 25 including a spiral 24. At an upper portion of this hopper 25, a toner tank 26 filled with a replenishing virgin toner is provided.

The virgin toner in the toner tank 26 is fed into the inside of the hopper 25, and replenished into the inside of the chamber 4*b* of the developing vessel 11 by the spiral 24. The virgin toner replenished into the inside of the chamber 4*b* is reciprocated between the chambers 4*b* and 4*a* by the spirals 22 and 21, mixed with the developer already existing within the developing vessel 11, and fed from the chamber 4*a* to the sleeve 10 and used for development.

The sleeve 10 is driven and rotated by a motor 50 and the spiral 24 within the hopper 25 is driven and rotated by a motor 27 which is driven independently from the motor 50. The motor 27 is ON-OFF controlled by the detected output of the toner concentration sensor 23.

On the other hand, a recovered toner reserving tank 30. The toner recovered by the cleaning apparatus 6 is accommodated temporarily within the reserving tank 30 by natural falling or suctioning.

A spiral 31 is provided at a bottom portion of the reserving tank 30, and its forward end extends to the inside of the hopper 25. A paddle 32 is provided in its forward end portion, and this paddle 32 adjoins the spiral 24. The recovered toner is sent into the inside of the hopper 25 by the spiral 31 and the paddle 32, mixed with the replenishing virgin toner with stirring, and replenished with the virgin toner into the developing vessel 11 so that the mixture will be use for development.

Usually, the spiral 31 and the paddle 32 may be driven as an integral unit with the sleeve 10 by a driving transmission means (for example, such as a worm and a gear) linked to the driving motor 50 of the sleeve 10.

(Developing Method)

The recycle development with the use of the above-mentioned developing apparatus proceeds in the following steps when it is shown by changes in the toner of of the developer in the developing vessel 11.

(1) Development by the toner of the starting developer.

(2) Development with the toner of the starting developer+the replenishing virgin toner+the recovered toner.

(3) Development with the replenishing virgin toner+the recovered toner.

(4) Development with the recovered toner.

The replenishing virgin toner, as already stated above, is mixed in advance with the recovered toner, and the mixture is then replenished into the developing vessel 11. The timing of this replenishing is when the toner concentration of the developing vessel 11 reaches a certain fixed value or below. When the output value of detected concentration of the toner concentration sensor 23 reaches a predetermined threshold value, the motor 27 is driven for a fixed period of time, and the spiral 24 in the hopper 25 operates to supply the virgin toner into the developing vessel 11. On the other hand, the toner recovered by the cleaning apparatus 6 is accommodated in the reserving tank 30, and simultaneously with the driving of the sleeve 10, the recovered toner is sent into the hopper 25 by the spiral 31 and the paddle 32 driven during the developing operation and is mixed with the virgin toner in the hopper 25 with stirring. Accordingly, the recovered toner is replenished with the virgin toner into the developing vessel 11 and the mixture is used for development.

By mixing the recovered toner in advance with the replenishing virgin toner and replenishing the mixture into the developing vessel 11 in this way, the homogeneity of the developer is maintained, and an abrupt decrease in the properties of the developer can be very favorably prevented.

In the process of the present invention, the threshold value of ON-OFF of the replenishing of the toner into the above-mentioned developing vessel 11 is preferably prescribed and varied according to a copying time, for example, the integrated value of the driving time of the motor 50 driving the sleeve 10. In other words, every time that the integrated value of the driving time of the motor 50 becomes a predetermined period of time, the threshold value of ON-OFF is prescribed. In this way, the recovered toner is replenished into the developing vessel 11, and even if a change in the properties of the developer occurs, unless the change if the properties is abrupt, it is possible to adjust the toner always to a fixed toner concentration.

The photosensitive drum 1 may be any known photosensitive material such as organic photosensitive materials, amorphous selenium and amorphous silicon. Generally, the organic photosensitive materials are preferred from the viewpoint of cost.

(Developing Agent)

In the present invention, two-component type magnetic developers composed of a toner and a magnetic carrier are used as the developer. As explained before, a replenishing virgin toner is used as a toner having lower flowability than the toner in the starting developer used at the time of starting.

Starting developer:

The toner in the starting developer may be a known toner prepared by dispersing toner compounding agents such as a colored pigment, a charging controlling agent, and a mold releasing agent in a fixing resin, and surface-treating the mixture with a flowability increasing agent.

Examples of the fixing resin include those containing fixability and electroscopic property, specifically styrene-type resins, styrene/acrylic resins, polyester resins, polyurethane resins, silicone resins, polyamide resins and modified rosins. Preferably, the styrene-acrylic resins are used.

The colored pigments are used usually in an amount of 2 to 20 parts by weight, especially 5 to 15 parts by weight, per 100 parts by weight of a fixing resin medium. Suitable examples are listed below.

Black Pigments

Carbon black, acetylene black, lamp black and aniline black.

Yellow Pigments

Chrome yellow, zinc yellow, cadmium yellow, yellow iron oxide, Mineral Fast Yellow, nickel titanium yellow, Naples Yellow, Naphthol Yellow S, Hansa Yellow G, Hansa Yellow 10 G, Benzidine Yellow G, Benzidine Yellow GR, quinonline yellow lake, Permanent Yellow NCG and tartrazine lake.

Orange Pigments

Chrome orange, molybdenum orange, Permanent Orange GTR, pyrazolone orange, Vulcan Orange, Indanthrene Brilliant Orange RK, Benzidine Orange G, and Indanthrene Brilliant Orange GK.

Red Pigments

Red iron oxide, cadmium oxide, red lead, cadmium mercury sulfide, Permanent Red 4R, Lithol Red, pyrazolone red, Wachung Red Calcium Salt, Lake Red D, Brilliant Carmine 6B, eosine lake, Rhodamine Lake B, Alizarine Lake and Brilliant Carmine 3B.

Violet Pigments

Manganese violet, Fast Violet B, and methyl violet lake.

Blue Pigments

Prussian blue, cobalt blue, alkali blue lake, Victoria Blue Lake, phthalocyanine blue, non-metallic phthalocyanine blue, phthalocyanine blue partly chlorinated product, Fast Sky Blue and Indanthrene Blue BC.

Green Pigments

Chrome green, chromium oxide, Pigment Green B, Malachite Green Lake and Fanal Yellow Green G.

White Pigments

Zinc white, titanium oxide, antimony white and zinc sulfide.

Extender Pigments

Baryta powder, barium carbonate, clay, silica, white carbon, talc and alumina white.

Examples of the charge controlling agent include oil-soluble dyes such as Nigrosin Base (C. I. 50415) and spiron black, metal-containing azo dyes, metal salts of naphthenic acid, metal salts of alkylsalycylic acids, fatty acid soaps, and resin acid soaps. The compounding amounts of these charge controlling agents are usually 0.1 to 10 parts by weight, especially 0.5 to 5 parts by weight, per 100 parts by weight of the fixing resin.

When the toner image formed by development and transferred to a predetermined paper is fixed by heat fixation, a mold releasing agent is compounded in order to apply mold releasability at the time of heat fixation. Examples of such a mold releasing agent include usually polyolefin resins, especially low-molecular-weight polypropylene. The amount of the mold releasing agent is usually 0.1 to 6 parts by weight per 100 parts by weight of the fixing resin medium.

The toner particles prepared by dispersing the toner compounding agent in the fixing resin can be produced by a known method such as a pulverization and classifying method, a melting granulating method, a spray granulating method, and a polymerization method. But the pulverization and classifying method is generally used. For example, the individual toner components are pre-mixed in a mixer such as a Henschel mixer, the mixture is kneaded by using a kneader such as a biaxial extruder, the kneaded composition is cooled, pulverized and classified to form a toner.

The particle diameter of the toner is a median diameter, measured by a Coulter counter, of 5 to 15 $\mu$m, especially 7 to 12 $\mu$m.

A flowability improver is adhered to the surface of the toner particles byoutward sprinkling and surface-treating the toner to thereby improve its flowability.

Examples of such a flowability improver are resin powders such as a fine powder of silica powder or an acrylic powder having a particle diameter of 0.005 to 0.05 $\mu$m, and hydrophobic gaseous phase method silica surface-treated with an organopolysiloxane or silazan. The amount of flowability improver may be 0.1 to 2.0% by weight based on the toner.

The transfer efficiency may be increased by adding such a flowability improver and spacer particles with a particle diameter of 0.05 to 1.0 $\mu$m and having a larger particle diameter than the flowability improver. By this outward sprinkling of the spacer particles, the bonding of the toner image to the latent image on the surface of the photosensitive material is weakened and the peeling of the toner image is easily performed. This makes it possible to increase the transfer efficiency in the toner image transferring step. When an organic photosensitive material is used as the photosensitive material, the outward sprinkling of the spacer particles gives an advantage that in development, the surface of the photosensitive material is abraded, and development can be carried out always on a virgin surface.

The spacer particles may be any organic or inorganic inert regular shaped particles having the above-mentioned particle diameter. Generally, magnetic powders, alumina, etc. may be used. When the magnetic powders are used as spacer particles, there is an advantage in that toner scattering can effectively prevented. Such spacer particles may be sprinkled on the surface of the toner in an amount of 0.1 to 1.5% by weight, especially 0.2 to 1.0% by weight, per the toner.

Suitable examples of the magnetic powders may include the following compounds. Tri-iron tetroxide ($Fe_3O_4$), iron-sesquioxide ($\gamma$-$Fe_2O_3$), zinc iron oxide ($ZnFe_3O_4$), yttrium iron oxide ($Y_3Fe_5O_{12}$), cadmium iron oxide ($CdFe_2O_4$), gadolium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), and nickel powder (Ni).

The magnetite (tri-iron tetroxide) is especially preferred.

In sprinkling the flowability improver and the spacer particles outwardly on the surface of the toner, the flowability improver and the spacer particles are mixed in advance intimately, the mixture is added to the toner, and the entire mixture is fully pulverized.

The toner for the starting developer so prepared has a toner falling amount, measured under the above-mentioned conditions, of usually 3.5 to 8.0 g/5 minutes, especially 4.5 to 6.5 g/5 minutes.

Magnetic carrier:

A known material such as ferrite or iron powder may be used as the magnetic carrier to be used as mixed with the above-mentioned toner. Its particle diameter is usually 50 to 120 $\mu$m, especially 85 to 105 $\mu$m.

The mixing ratio between the magnetic carrier and the toner is preferably 98:2 to 90:10 by weight, especially 97:3 to 92:8 by weight.

(Replenishing Virgin Toner)

In the present invention, the virgin toner to be replenished corresponding to the consumption of the toner by the development has the same composition as the toner of the starting developer except that the toner falling amount, showing its flowability, is prescribed at 50 to 70%, especially 55 to 65%, based on the toner of the starting developer.

The toner falling amount may be easily adjusted by adjusting the amount and the particle diameter of the surface-treating agent. For example, when the amount of the flowability improver is made larger, the amount of the toner falling becomes larger. When the amount of the flowability improver is made smaller, the amount of the toner falling becomes smaller. Furthermore, as the particle diameter of the surface-treating agent is smaller, the toner falling amount becomes larger, and when the particle diameter of the surface-treating agent is larger, the toner falling amount becomes smaller. Accordingly, by increasing the amount of the spacer particles having a large particle diameter among the surface-treating agents, the flowability of the replenishing virgin toner can be prescribed within the above-mentioned range. Such a replenishing virgin toner may usually be mixed with 100 to 300 parts by weight of the recovered toner per 100 parts by weight of the recovered toner.

According to this invention, by decreasing the flowability of the replenishing virgin toner as compared with the toner of the starting developer, it is possible to suppress an abrupt lowering in the properties of the developer of the developer by the mixing of the recovered toner. For example, by prescribing the threshold value of ON-OFF of supplying the replenishing toner, it is possible to maintain the toner concentration always at a fixed value, and development can be stably performed.

EXAMPLES AND COMPARATIVE EXAMPLES

The following Examples and Comparative Examples will illustrate the present invention.

(Example 1)

Preparation of Toner Particles

In accordance with the following recipe, the individual agents mentioned below were melt kneaded by a biaxial extruder. The resulting kneaded mixture was pulverized by a jet mill, and classified by a wind-powered classifier to give toner particles having an average particle diameter of 10.0 μm.

Toner recipe:

Fixing resin: 100 parts by weight

Coloring agent: 10 parts by weight

Charge controlling agent: 1 part by weight

Mold releasing agent: 5 parts by weight

Preparation of a Surface-treating Agent

The following two types of surface-treating agent were prepared.

Alumina-pretreated agent:

Alumina (made by Sumitomo Chemical Co., Ltd. under the tradname of AKP-20) having a central particle diameter of 0.5 μm and a hydrophobic silica powder (made by Cabbot Co., Ltd. under the tradename of TS-720) having a particle diameter of 0.015 μm were mixed for 1 minute by using a vita mix in a weight ratio of 10:1 to give an alumina-pretreated agent.

Magnetite-pretreated agent:

Magnetite (made by Titanium Industry Co., Ltd. under the tradename of BR-220) having a saturated magnetization of 83 emu/g and a central particle diameter of 0.3 μm and the above-mentioned hydrophilic silica powder were mixed for 1 minute by using a vita mix in a weight ratio of 10:1 to give a magnetite-pretreated agent.

Preparation of a Starting Developer

The magnetite-pretreated agent (0.25% by weight) was added to the the prepared toner particles, and they were mixed for 2 minutes by a Henschel mixer to give a magnetite-treated toner. Then, 0.3% by weight of the hydrophobic silica powder used in the preparation of the above-mentioned surface-treating agent was added to the magnetite-treated toner. They were mixed for 2 minutes by a Henschel mixer to prepare a toner for the starting toner. By using the apparatus shown in FIG. 4, the falling amount of the toner under the conditions shown in the specification was measured. The results are shown in Table 1.

This toner for the starting developer and a ferrite carrier (Powder Tech Co., Ltd. under the tradename of FL184-150) having an average particle diameter of 80 μm were mixed by a ball mill at 75 rpm for 2 hours to give a starting developer having a toner concentration of 4.5%.

Preparation of a Replenishing Virgin Toner

The above-mentioned alumina-pretreated agent (1.0% by weight) was mixed with the toner particles prepared above by a Henschel mixer for 2 minutes to prepare an alumina-treated toner. Thereafter, 0.3% by weight of the hydrophobic silica powder used in the above-mentioned preparation of the above-mentioned surface treating agent was added to this alumina-treated toner. They were mixed for 2 minutes by a Henschel mixer to prepare a replenishing virgin toner. The falling amount of this toner was measured. The results are shown in Table 1.

Experiment

A copying machine DC-2556 made by Mita Industrial Co., Ltd. using an organic photosensitive material was remodelled into a recycle-type machine shown in FIG. 4. Using the starting toner and the replenishing virgin toner, continuous copying was performed through 30,000 sheets under the following conditions, and T/D controllability, fogging and toner scattering were evaluated. The results are shown in Table 1.

Surface potential of the photosensitive material: 800 V

Bias voltage between drum and sleeve: 300 V Drum/sleeve peripheral speed ratio: 3.0

Figure 5:
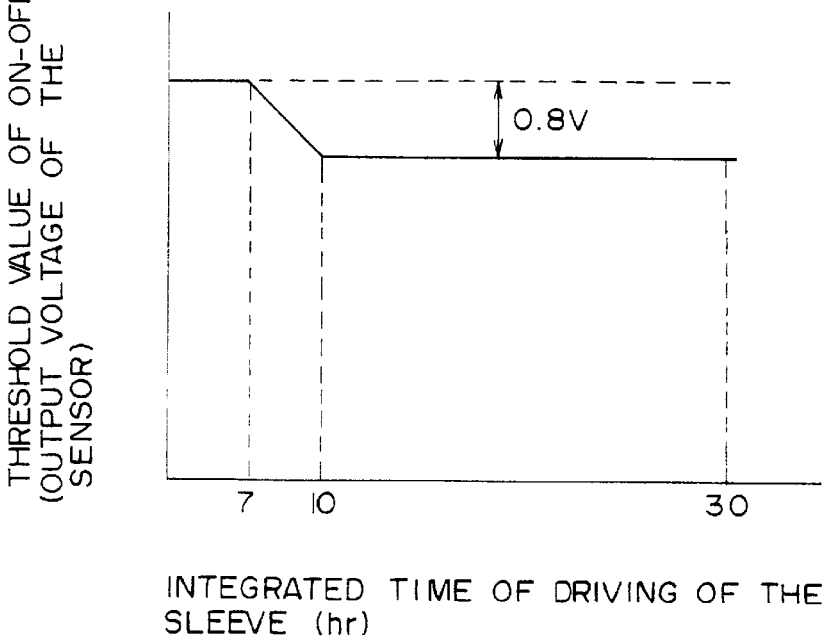
FIG. 5 is a view showing variations of the threshold value of the output of a toner concentration sensor for performing ON-OFF control of the supply of the toner in an experiment of an Example.

The virgin toner was mixed with the recovered toner in an amount of 100 to 300 parts by weight per 100 parts by weight of the recovered toner, and the mixture was replenished. The toner concentration was controlled by varying the threshold value of ON-OFF control of supplying the toner by the output of the sensor in accordance with the flow chart shown in FIG. 5.

The test items were evaluated in the following manners.

T/D controllability:

When the toner concentration in the developer could be stabilized at 3.8%, the evaluation was shown as ○, and even when by adjusting the variations of the threshold value, the toner concentration could not be stabilized at 3.8%, the evaluation was show as X.

Fogging:

Fogging densities at the first sheet (early period), 15,000th sheet and 30,000th sheet were shown.

Toner scattering:

The degree of toner scattering in the inside of the machine at the end of the experiment and in the image of the 30,000th sheet were judged visually, and the results were shown on the following standards.

○: No toner scattering.

Δ: Toner scattering was slightly observed, but had no effect on the image.

X: Toner scattering occurred to such an extent that toner dropping on the image was seen.

(Example 2)

Preparation of a Surface Treating Agent

Alumina-pretreated agent: Alumina (made by Sumitomo Chemical Co., Ltd. under a tradename of AKP-50) having a central particle diameter of 0.2 μm was mixed with the hydrophobic silica powder (having a central particle diameter of 0.015 μm) used in Example 1 for 1 minute by a vita mix in a weight ratio of 10:1 to prepare an alumina-pretreated agent.

Starting Developer

The same starting developer as used in Example 1 was used.

Preparation of a Replenishing Virgin Toner

In the same way as in Example 1, a replenishing virgin toner was prepared except that the alumina-pretreated agent prepared above was added to the toner particles prepared in Example 1 (1.0% by weight of the alumina-pretreated agent). The fallen amount of the toner was measured, and the results are shown in Table 1.

Experiment

Using the starting developer and the replenishing virgin toner, the same experiment as in Example 1 was carried out. The results are shown in Table 1.

(Example 3)

Starting Developer

The hydrophobic silica powder (0.3% by weight) used in Example 1 was added to the toner particles prepared in Example 1. They were mixed for 2 minutes by a Henschel mixer to prepare a toner for the starting developer. The fallen amount of the toner was measured, and the results are shown in Table 1.

A starting developer having a toner concentration of 3.5% was prepared in the same way as in Example 1 except that the above toner for the starting developer was used.

Preparation of a Replenishing Virgin Toner

An acrylic fine powder having a central particle diameter of 0.25 μm was added in an amount of 0.5% by weight to the toner particles prepared in Example 1 to obtain an acrylic powder-treated toner. A replenishing virgin toner was prepared in the same way as in Example 1 except that this acrylic powder-treated toner was used. The falling amount of the toner was measured, and the results are shown in Table 1.

Experiment

Using the above-mentioned starting developer and the replenishing virgin toner, the same experiment as in Example 1 was carried out. The results are shown in Table 1.

(Comparative Example 1)

Using the same starting toner prepared in Example 1, the same toner as in the starting developer was used as the replenishing virgin toner. Otherwise, the same experiment as in Example 1 was carried out. The results are shown in Table 1.

(Comparative Example 2)

Preparation of a Replenishing Virgin Toner

An acrylic fine powder having a central particle diameter of 0.5 μm was added in an amount of 1.0% by weight to the toner particles prepared in Example 1 to obtain an acrylic powder-treated toner. A replenishing virgin toner was prepared in the same way as in Example 1 except that this acrylic powder-treated toner was used. The falling amount of the toner was measured, and the results are shown in Table 1.

Experiment

The same experiment as in Example 1 was carried out except that the above-mentioned replenishing virgin toner was used. The results are shown in Table 1.

(Comparative Example 3)

Preparation of a Replenishing Virgin Toner

The hydrophobic silica fine powder used in Example 1 was added in an amount of 0.1% by weight to the toner particles prepared in Example 1. They were mixed for 2 minutes by a Henschel mixer to prepare a replenishing virgin toner. The falling amount of the toner was measured, and the results are shown in Table 1.

Experiment

The same experiment as in Example 3 was carried out except that the above-mentioned replenishing virgin toner was used. The results are shown in Table 1.

TABLE 1

| | Examples | | | Comparative Examples | | |
|---|---|---|---|---|---|---|
| | 1 | 2 | 3 | 1 | 2 | 3 |
| Toner falling amount (g/5 min) | | | | | | |
| Replenishing toner (A) | 3.47 | 3.88 | 3.13 | 5.65 | 2.61 | 4.45 |
| Starting toner (B) | 5.65 | 5.65 | 5.90 | 5.65 | 5.65 | 5.90 |
| Toner falling amount ratio | | | | | | |
| A/B × 100 (%) | 61.4 | 68.7 | 53.0 | 100 | 46.2 | 75.4 |
| Paformance of the copying machine | | | | | | |
| T/D control | ○ | ○ | ○ | X | ○ | X |
| Fogging | | | | | | |
| Initial period | 0.001 | 0.000 | 0.000 | 0.000 | 0.001 | 0.000 |
| 15,000th sheet | 0.003 | 0.004 | 0.004 | 0.007 | 0.009 | 0.008 |
| 30,000th sheet | 0.003 | 0.003 | 0.004 | 0.010 | 0.009 | 0.010 |
| Toner scattering | ○ | ○ | ○ | X | X | Δ |

Comparative Example 1, T/D controlling became difficult when about 10,000 sheets were copied. In Comparative Example 3, T/D controlling became difficult when about 18,000 sheets were copied.

In Examples and Comparative Examples, a replenishing virgin toner was replenished for the first time when about 3000th sheet was copied.

According to this invention, a replenishing virgin toner having a toner falling amount of 50 to 70% as compared with the toner of the starting developer is used, whereby an abrupt decrease in the properties of the developer due to the mixing of the toner can be relaxed. As a result, a stable image free from fogging or toner scattering can be formed by the recycle developing process. Furthermore, by adjusting the threshold value of the output of the sensor of ON-OFF control of supplying the toner into the developing vessel by the image forming time, a fixed toner concentration can always be maintained even when the recovered toner is used.

What is claimed is:

1. A recycle developing process which comprises:

developing an electrostatic image formed on a photosensitive material with a starting developer composed of an electroscopic toner and a magnetic carrier filled in a developing vessel to form a toner image, said starting developer having a predetermined concentration of toner therein;

transferring the toner image to a predetermined paper;

recovering the toner remaining on the photosensitive material by a cleaning means; and repeatedly performing development while maintaining said predetermined concentration of toner in the developer by replenishing a virgin toner and the toner recovered by the cleaning means into the developing vessel;

wherein the virgin toner to be replenished into the developing vessel has a flowability of 50 to 70% based on that of the toner in the starting developer, the flowability being shown as a toner falling amount that is measured by filling the toner in a container in which a rotating roller is provided in an opening portion at a lower portion and falling the toner via the rotating roller for a certain fixed time;

wherein the toner in the starting developer is surface-treated with flowability improver particles having a particle diameter of 0.005 to 0.05 $\mu$m and spacer particles having a particle diameter of 0.05 to 1.0 $\mu$m;

wherein the amount of spacer particles contained in the replenishing virgin toner is larger than that of the spacer particles in the toner in the starting developer.

* * * * *